US008983758B2

(12) United States Patent
Zaitsu et al.

(10) Patent No.: US 8,983,758 B2
(45) Date of Patent: Mar. 17, 2015

(54) TRAFFIC INFORMATION MANAGEMENT DEVICE, TRAFFIC INFORMATION MANAGEMENT METHOD, AND TRAFFIC INFORMATION MANAGEMENT PROGRAM

(75) Inventors: Tomoyuki Zaitsu, Okazaki (JP); Shinji Kachi, Okazaki (JP); Kenji Nagase, Okazaki (JP); Tsuyoshi Iwata, Nagoya (JP); Takahisa Ozaki, Kariya (JP); Masamiki Andoh, Kariya (JP); Toshio Inoguchi, Nagoya (JP); Kazunori Watanabe, Okazaki (JP); Teruhide Hayashida, Shinagawa-ku (JP)

(73) Assignees: Aisin Aw Co., Ltd., Anjo (JP); Denso Corporation, Kariya (JP)

( * ) Notice: Subject to any disclaimer, the term of this patent is extended or adjusted under 35 U.S.C. 154(b) by 734 days.

(21) Appl. No.: 13/203,891

(22) PCT Filed: Mar. 4, 2010

(86) PCT No.: PCT/JP2010/001484

§ 371 (c)(1),
(2), (4) Date: Nov. 3, 2011

(87) PCT Pub. No.: WO2010/103753

PCT Pub. Date: Sep. 16, 2010

(65) Prior Publication Data

US 2012/0041669 A1 Feb. 16, 2012

(30) Foreign Application Priority Data

Mar. 11, 2009 (JP) ..... 2009-057469

(51) Int. Cl.
*G08G 1/0967* (2006.01)

(52) U.S. Cl.
CPC ..... *G08G 1/096741* (2013.01)
USPC ..... 701/117

(58) Field of Classification Search
CPC ..... G08G 1/0104; G08G 1/0141; G08G 1/096716; G08G 1/096775; G08G 1/096741; G08G 1/20
USPC ..... 701/117–119, 201, 202, 204, 207, 210, 701/213, 408–410, 412, 414, 416
See application file for complete search history.

(56) References Cited

U.S. PATENT DOCUMENTS

2005/0222755 A1 10/2005 Tengler et al.
2007/0153704 A1 * 7/2007 Min et al. ..... 370/252
2013/0304367 A1 * 11/2013 Stehle et al. ..... 701/117

FOREIGN PATENT DOCUMENTS

CN 1451149 A 10/2003
CN 1655207 A * 8/2005

(Continued)

OTHER PUBLICATIONS

Japanese Patent Office, Notification of Reason for Refusal mailed Nov. 8, 2011 in Japanese Patent Application No. 2009-057469 w/Partial English-language Translation.

(Continued)

*Primary Examiner* — Mary Cheung
*Assistant Examiner* — Rodney Butler
(74) *Attorney, Agent, or Firm* — Oliff PLC

(57) ABSTRACT

Conventionally, different traffic information cannot be sent in accordance with an output reason of a request to send. According to the present invention, a request to send traffic information, which is output in response to an instruction given by a user operation or an automatically given instruction, is acquired, an output reason of the request to send is determined, and a communication unit is controlled so that the traffic information on different areas is sent depending on the cases where the output reason is the instruction given by the user operation or the automatically given instruction.

5 Claims, 4 Drawing Sheets

(56) References Cited

FOREIGN PATENT DOCUMENTS

| | | | | |
|---|---|---|---|---|
| CN | 1920481 | A | | 2/2007 |
| DE | 196 51 143 | A1 | | 6/1998 |
| FR | 2884379 | A1 | * | 10/2006 |
| JP | A-2002-286469 | | | 10/2002 |
| JP | A-2003-217088 | | | 7/2003 |
| JP | A-2004-125504 | | | 4/2004 |

OTHER PUBLICATIONS

International Search Report dated Jul. 6, 2010 in International Application No. PCT/JP2010/001484.

Jul. 22, 2013 Search Report issued in Application No. 2010800091104 (with translation).

* cited by examiner

TRAFFIC INFORMATION MANAGEMENT DEVICE, TRAFFIC INFORMATION MANAGEMENT METHOD, AND TRAFFIC INFORMATION MANAGEMENT PROGRAM

TECHNICAL FIELD

The present invention relates to a traffic information management device, an information transmission device, a traffic information management method, and a traffic information management program.

BACKGROUND ART

Conventionally, there has been known technologies for distributing traffic information to a navigation system. For example, in the technique disclosed in Patent Citation 1, the traffic information is acquired in response to an instruction given by a user operation for the navigation system or an automatically given instruction. Moreover, the Patent Citation 1 discloses that in the case where a traveling route is set and a route guidance processing is being executed, the traffic information included in the predetermined area in accordance with the traveling route is sent, while in the case where the traveling route is not set, the traffic information on the predetermined area around the position of the own vehicle is sent.

CITATION LIST

Patent Literature

PTL 1: Japanese Patent Application Publication No. 2002-286469

SUMMARY OF INVENTION

Technical Problem

In the conventional technologies, an area associated with the traffic information which is used as an object to be sent depends on the presence or absence of setting of the traveling route, and does not depend on output reasons (an instruction given by a user operation or an automatically given instruction) of a request to send the traffic information. Thus, in the conventional technologies, it is not possible to send the traffic information on different areas for each output reason of the request to send the traffic information. However, the different output reasons of the request to send the traffic information would need the traffic information on the different areas. For example, consider the configuration in which a map is displayed on a display unit mounted on a vehicle and the map can be scrolled in response to the user instructions. If the request to send is made by the user operation with the scrolled map being displayed, it would be preferable to send the traffic information associated with the displayed map. On the other hand, the traffic information which is automatically requested to be sent is the constantly used traffic information. Thus, it would be preferable to send the traffic information on the area independent of the scrolled map.

The present invention was made in light of the aforementioned problem, and an object of the present invention is to send the traffic information on different areas for each output reason of the request to send.

Solution to Problem

To attain the object, in the present invention, a request to send the traffic information is acquired, and it is determined whether the output reason of the traffic information is either an instruction given by a user operation or an automatically given instruction. In addition, a communication unit is controlled so that the traffic information on the different areas is sent depending on the cases where the output reason is the instruction given by the user operation or the automatically given instruction. As a result, the traffic information management device can be configured to send the traffic information on the areas in accordance with each of the cases where the output reason is the instruction given by the user operation and the automatically given instruction.

Here, a request-to-send acquiring unit may be configured in any manner as long as the unit can acquire the request to send the traffic information which is output in response to the instruction given by the user operation or the automatically given instruction. Specifically, consider the configuration in which the navigation system or the like mounted on the vehicle outputs the request to send the traffic information in response to each of the instruction given by the user operation and the automatically given instruction. In such configuration, the request-to-send acquiring unit may be configured in any manner as long as the unit can acquire the output request to send. The instruction given by the user operation may be acquired in accordance with the operation on any user interface. The automatically given instruction may be acquired at a predetermined timing.

An output reason determining unit may be configured in any manner as long as the unit can determine the output reason of the request to send. For example, consider the configuration in which the information indicating the output reason of the request to send is sent along with the request to send. In such configuration, the output reason determining unit may employ the configuration in which the information indicating the output reason is analyzed or the like. A traffic information transmission control unit may be configured in any manner as long as the unit can control the communication unit so that the communication unit sends the traffic information on the different areas in accordance with the output reasons. Each area may be appropriately defined in accordance with the output reasons. Any method for defining the areas such that the different areas are allocated to each output reason may be determined in advance. Alternatively, the areas may be defined in consideration of other elements in addition to the output reasons.

For example, the traffic information management device may employ the configuration in which the area of the traffic information is defined based on a current position of the vehicle or a display area of the map which is displayed on the display unit mounted on the vehicle. In the case where the output reason is the instruction given by the user operation, the traffic information on a first area is sent, the first area being set to include at least the display area of the map at the time the instruction was given by the user operation. With this configuration, the traffic information management device can be configured to send the traffic information on the first area corresponding to the display area of the map which is displayed on the display unit in accordance with the user operation. Note that in the case where the output reason is the instruction given by the user operation, it is preferable to acquire the information associated with the map displayed on the display unit at the time the instruction was given, and display the information on the display unit. Therefore, by setting the traffic information to be displayed as the traffic information on the first area, the information which is viewed along with the map can be sent.

Moreover, in the case where the output reason is the automatically given instruction, the traffic information on a second area set around the current position is sent. With this configuration, the traffic information management device can be configured to automatically send the traffic information on the second area corresponding to the current position even when the current position of the vehicle varies. Note that the traffic information on the second area set around the current position is likely to be constantly used. Therefore, in the case where the output reason is the automatically given instruction, the traffic information having a high probability of being used can be sent by employing the configuration in which the traffic information on the second area corresponding to the current position is automatically sent.

The display area of the map is configured to be variable in response to the user operation, and is configured, for example, to be scaled down or to change a display position on the display unit. The first area may be set in any manner as long as the first area includes a viewing range on the display unit. In other words, the first area may be set in any manner as long as the first area is defined as the area for identifying the traffic information on the map displayed on the display unit.

The second area may be any area as long as the second area is set around the current position of the vehicle. Specifically, the second area may be any area as long as the second area may be defined as the area where the traffic information is to be sequentially updated in association with the change of the current position of the vehicle. Of course, the traffic information management device may be configured to set the second area in consideration of other elements in addition to the current position, e.g., so as to include at least the display area of the display unit with the current position being included in the map displayed on the display unit.

Moreover, the traffic information management device may be configured such that the traffic information having different attribution is sent in accordance with the output reason of the request to send. For example, in the case where the output reason is the instruction given by the user operation, the traffic information management device is configured to send the traffic information on all road types of roads included in the map displayed on the display unit at the time the request to send was output. With this configuration, in the case where the instruction was given by the user operation in sending the traffic information on the roads, it is possible to use the traffic information on all road types as an object to be sent without distinguishing the road types. As a result, the vehicle which received the sent traffic information becomes able to guide the traffic information on all the road types of roads on the map displayed on the display unit.

In the case where the output reason is the automatically given instruction, the traffic information management device is configured to select an objet-to-be-sent road type in accordance with a road type of a road where the current position is present, and to send the traffic information on one or more roads of the objet-to-be-sent road type. With this configuration, it is possible to limit the traffic information to be sent, by selecting the roads in accordance with the road type. As a result, the volume of the traffic information which is automatically sent can be controlled.

A specific method for selecting the road type in the case where the output reason is the automatically given instruction can employ various configurations. For example, the method can employ the configuration in which a toll road type is selected as the object-to-be-sent road type in the case where the road type of the road where the current position is present is the toll road type, while the all road types of roads included in the map displayed on the display unit are selected as the object-to-be-sent road type, in the case where the road type of the road where the current position is present is other than the toll road type.

With this configuration, in the case where the vehicle is traveling on the toll road and the traffic information on the road type other than the toll road type is not needed at the moment and the traffic information on the toll road type is needed, such needed traffic information on the toll road type can be automatically sent. Therefore, it is possible to automatically send the traffic information with the exclusion of unnecessary traffic information.

The method for selecting the object-to-be-sent road type, in the case where the road type of the road where the current position is present is other than the toll road type, can employ various configurations, in addition to the configuration in which the all road types included in the map are set as the object-to-be-sent road type. For example, the method may have the configuration in which the same road type as the road type of the road where the current position is present is selected as the object-to-be-sent road type.

Moreover, even on the road of the road type which is selected as an object-to-be-sent road type, the traffic information on all the roads may not be sent, and a part of the roads may be excluded from the object to be sent. For example, the traffic information management device may be configured not to send the traffic information on the road opposite to the road in the traveling direction of the vehicle in relation to the current position of the vehicle.

It is possible to apply, to a method for performing the processing and a program, the techniques for sending the traffic information on different areas depending on the cases where the output reason is the instruction given by the user operation and the automatically instruction, as disclosed in the present invention. The foregoing traffic information management device, method, and program are provided as a single device in some cases and as a plurality of devices in other cases. Moreover, the traffic information management device, method, and program include various aspects; they are provided using the common component to each part constituting the vehicle, or are provided in cooperation with any unit which is not mounted on the vehicle. Moreover, it is possible to change the present invention appropriately such as partially software and partially hardware. Furthermore, the invention is also realized as a recording medium of the program controlling the traffic information management device. Of course, the recording medium of the software may be magnetic recording medium or magneto-optical medium, and any recording medium to be developed in the future can be assumed in the totally same manner.

DESCRIPTION OF EMBODIMENTS

Here, embodiments of the present invention will be described in the following order:

(1) Configuration of Traffic Information Management System (1-1) Configuration of Navigation System (1-2) Configuration of Traffic Information Management Device (1-3) Processing in the Case where Output Reason is an Instruction Given by User Operation (1-4) Processing in the Case where Output Reason is an Automatically Given Instruction (2) Other Embodiments

Figure 1:
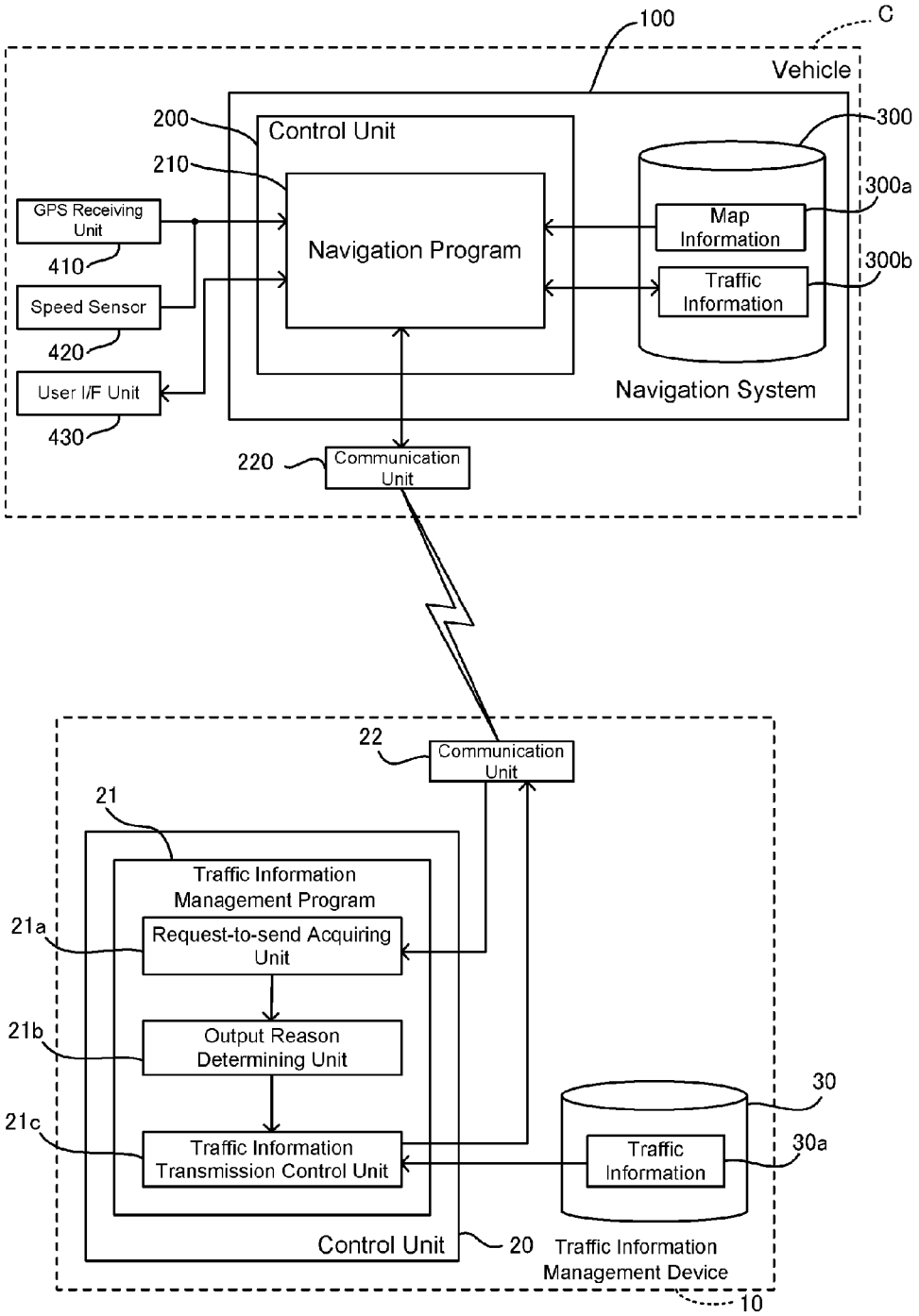
FIG. 1 is a block diagram illustrating a traffic information management device.

(1) Configuration of Traffic Information Management System (1-1) Configuration of Navigation System FIG. 1 is a block diagram illustrating a configuration of a system comprising a navigation system 100 equipped in a vehicle C and a traffic information management device 10, which is placed in the traffic information control center. The navigation system 100 is mounted on a plurality of vehicles C traveling on roads. The navigation system 100 comprises a control unit 200 having CPU, RAM, ROM or the like, and a recording medium 300. The control unit 200 can execute programs stored on the recording medium 300 or ROM. In this embodiment, a navigation program 210 is executable as one of the programs, and the control unit 200 can conduct route search based on map information 300*a* recorded on the recording medium 300 by the navigation program 210. In addition, the control unit 200 can acquire traffic information 300*b* on different locations so that guidance is provided.

The map information 300*a* is recorded on the recording medium 300, and the map information 300*a* includes node data indicating nodes which are set on the roads where the vehicles travel, shape interpolated data for identifying shapes of the roads between nodes, link data indicating the connection between the nodes, facility data indicating facilities where may be a destination of a planned traveling route, or the like. The GPS receiving unit 410 receives radio waves from a GPS satellite, and outputs information for calculating a current position of the vehicle via an interface (not shown). The control unit 200 acquires the signal and acquires the current position of the vehicle. A speed sensor 420 outputs a signal associated with the rotational speed of the wheel of the vehicle C. The control unit 200 acquires the signal via the interface (not shown) and acquires the speed of the vehicle C. The control unit 200 identifies the current position of the vehicle C based on the output signal of the GPS receiving unit 410 and the speed sensor 420, and the map information 300*a*.

A user I/F unit 430 is an interface unit to which the user inputs instructions and which provides the user with various information, and comprises a display unit, a button, a speaker, or the like (not shown). The control unit 200 receives a destination input via the user I/F unit 430 to conduct route search by a processing of the navigation program 210. In addition, the control unit 200 can provide guidance to guide the vehicle C to the destination while displaying the current position and the planned traveling route of the vehicle C on the display by the processing of the navigation program 210.

In this process, the control unit 200 displays the map on the display unit of the user I/F unit 430 and displays the current position and the planned traveling route of the vehicle C on the map. The user I/F unit 430 comprises a scroll instruction button for scrolling the map displayed on the display unit. The user can provide an instruction with the control unit 200 to switch a viewing range of the map which is displayed on the display unit by an operation of the scroll instruction button. The control unit 200 switches the range of the map which is displayed on the display unit in response to the instruction by the processing of the navigation program 210.

Therefore, in the configuration in which the current position of the vehicle C and the map of any area can be displayed on the display unit, the embodiment provides the configuration in which the route search is conducted using the traffic information, a variety of traffic information is displayed on the map, and vocal guidance is provided based on the traffic information during the route guidance. The traffic information is acquired from the traffic information management device 10 by communications, and is recorded on the recording medium 300 (which is referred to as traffic information 300*b*). In this embodiment, the traffic information 300*b* includes present-state traffic information, which indicates a current state in each road section identified by the node data and the link data, and predicted traffic information which indicates the state predicted for each road section. In addition, the present-state traffic information and the predicted traffic information, which are included in the traffic information 300*b*, include information on objects to be displayed, which corresponds to the objects to be displayed on the display unit of the user I/F unit 430, information on objects to be voice guided, which corresponds to the objects to be voice output from the speaker of the user I/F unit 430, and information for route search, which is referred to by the control unit 200 during the route search. In this embodiment, the information to be displayed includes degree-of-traffic-jam information and regulatory information on each road section. The information to be voice guided includes traffic jam guidance information for providing the guidance on a degree of traffic jam in each road section, and weather information in each region. Moreover, the information for route search includes cost information on each road section.

In the embodiment, the traffic information 300*b* is sent for two types of output reasons. Specifically, the control unit 200 outputs a request to send the traffic information 300*b* via the communication unit 220 in the case where the user operation instructs the transmission of the traffic information 300*b*. Moreover, the request to send the traffic information 300*b* is automatically output via the communication unit 220 in the case where a predetermined transmission time period has passed. Note that the communication unit 220 comprises a circuit for communicating with the traffic information management device 10, and thereby the communication unit 220 can output the request to send the traffic information 300*b* to the traffic information management device 10 in response to the instructions from the control unit 200 and can acquire the traffic information 300*b* sent by the traffic information management device 10.

In order to give an instruction to send the traffic information 300*b* by the user operation, the user I/F unit 430 comprises a request-to-send button for requesting the sending of the traffic information. When the user instructs the output of the request to send the traffic information by operating the request-to-send button, the control unit 200 outputs the request to send via the communication unit 220 by the processing of the navigation program 210.

On the other hand, the control unit 200 always determines whether the predetermined transmission time period (e.g., five minutes) has passed based on a clock circuit (not shown), and automatically outputs the request to send the traffic information 300*b* every time the transmission time period has passed. Note that a variety kind of periods can be set as the transmission time period. For example, the time period may be the period during which the vehicle C travels a certain distance.

Moreover, in the embodiment, a variety of information can be sent along with the request to send such that the traffic information management device 10 can identify the traffic information 300*b* to be sent and execute the sending processing. Specifically, when the request to send is made, the control unit 200 sends, along with the request to send, information which indicates the traffic information 300*b* stored on the recording medium 300 of the vehicle C, information which indicates the output reason of the request to send, information which indicates a viewing range of the map on the display unit, information which indicates the current position of the vehicle C, information which indicates road types of the road where the current position of the vehicle C is present, and information which indicates a destination of the vehicle if the destination is set.

(1-2) Configuration of Traffic Information Management Device

Next, there will be described a configuration of the traffic information management device 10 for determining the traffic information to be sent in response to the aforementioned request to send. The traffic information management device 10 comprises a control unit 20 having CPU, RAM, ROM or the like, and a recording medium 30. The control unit 20 can execute programs stored on the recording medium 30 or ROM. In this embodiment, the control unit 20 can execute one of the programs, a traffic information management program 21, by which the control unit 20 sends the traffic information in response to the request to send.

It is noted that traffic information 30*a* that may be sent is recorded in advance on the recording medium 30. Specifically, the traffic information management device 10 generates the traffic information based on probe information sent from the plurality of vehicles C, and the information sent from the sensors which are installed around the roads and a weather information providing device. The generated traffic information is stored on the recording medium 30 as the traffic information 30*a*. As for the traffic information 30*a*, the degree-of-traffic-jam information and the regulatory information are defined as the information to be displayed for each road section which is associated with the aforementioned link data, the traffic jam guidance information and the weather information are defined as the information to be voice guided for each road section, and the cost information is defined as the information for route search for each road section. The respective pieces of information include the present state information and the predicted information as described above.

The traffic information management program 21 includes a request-to-send acquiring unit 21*a*, an output reason determining unit 21*b*, and a traffic information transmission control unit 21*c*. Moreover, the traffic information management device 10 comprises a communication unit 22 which is made up of a circuit for communicating with the vehicle C. The request-to-send acquiring unit 21*a* is a module for providing the control unit 20 with a function that allows the acquisition of the request to send. The control unit 20 acquires the request to send the traffic information which is output in response to the instruction given by the user operation via the communication unit 22. Alternatively, the control unit 20 acquires the request to send the traffic information which is output in response to the automatically given instruction via the communication unit 22.

Figure 2:
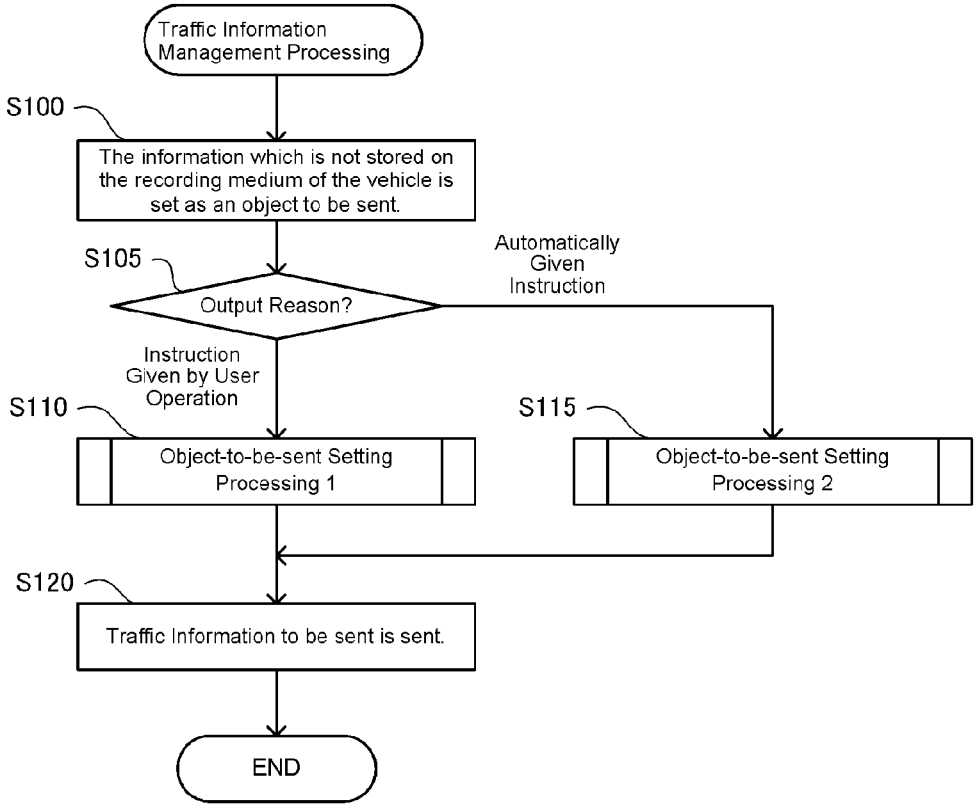
FIG. 2 is a flow chart illustrating a traffic information management processing.

The output reason determining unit 21*b* is a module for providing the control unit 20 with a function that allows the determination of the output reason of the request to send. The traffic information transmission control unit 21*c* is a module for providing the control unit 20 with a function that allows the control of the communication unit 22 to send the traffic information. When the control unit 20 acquires the request to send by the processing of the request-to-send acquiring unit 21*a*, the processing shown in FIG. 2 is executed.

In the processing, the control unit 20 sets the information that is not stored on the recording medium 300 of the vehicle C to an object to be sent, by the processing of the traffic information transmission control unit 21*c* (Step S100). Specifically, the control unit 20 refers to the information which is sent along with the request to send and indicates the traffic information 300*b* stored on the recording medium 300 of the vehicle C, and excludes the information that is already recorded on the recording medium 300 as the traffic information 300*b* from the object to be sent.

Next, the control unit 20 determines the output reason of the request to send by the processing of the output reason determining unit 21*b* (Step S105). Specifically, the control unit 20 acquires the information indicating the output reason of the request to send, which is sent along with the request to send, to determine the output reason of such request to send. In Step S105, in the case where the control unit 20 determines that the output reason of the request to send is the instruction given by the user operation, the control unit 20 executes an object-to-be-sent setting processing 1 by the processing of the traffic information transmission control unit 21*c* (Step S110). In Step S105, in the case where the control unit 20 determines that the output reason of the request to send is the automatically given instruction, the control unit 20 executes an object-to-be-sent setting processing 2 by the processing of the traffic information transmission control unit 21*c* (Step S115).

After the object-to-be-sent setting processing 1 or the object-to-be-sent setting processing 2, the control unit 20 sends the traffic information to be sent by the processing of the traffic information transmission control unit 21*c* (Step S120).

Specifically, the control unit 20 controls the communication unit 22 to send the traffic information that is set as an object to be sent to the vehicle C which requested to send the traffic information. Here, the object-to-be-sent setting processing 1 and the object-to-be-sent setting processing 2 are configured to set the traffic information on different areas as the object to be sent. In each processing, the information needed for each output reason of the request to send is selected to set as the object to be sent (which will be described below in detail). Therefore, the traffic information on the appropriate area can be sent for each output reason of the request to send.

Figure 3:
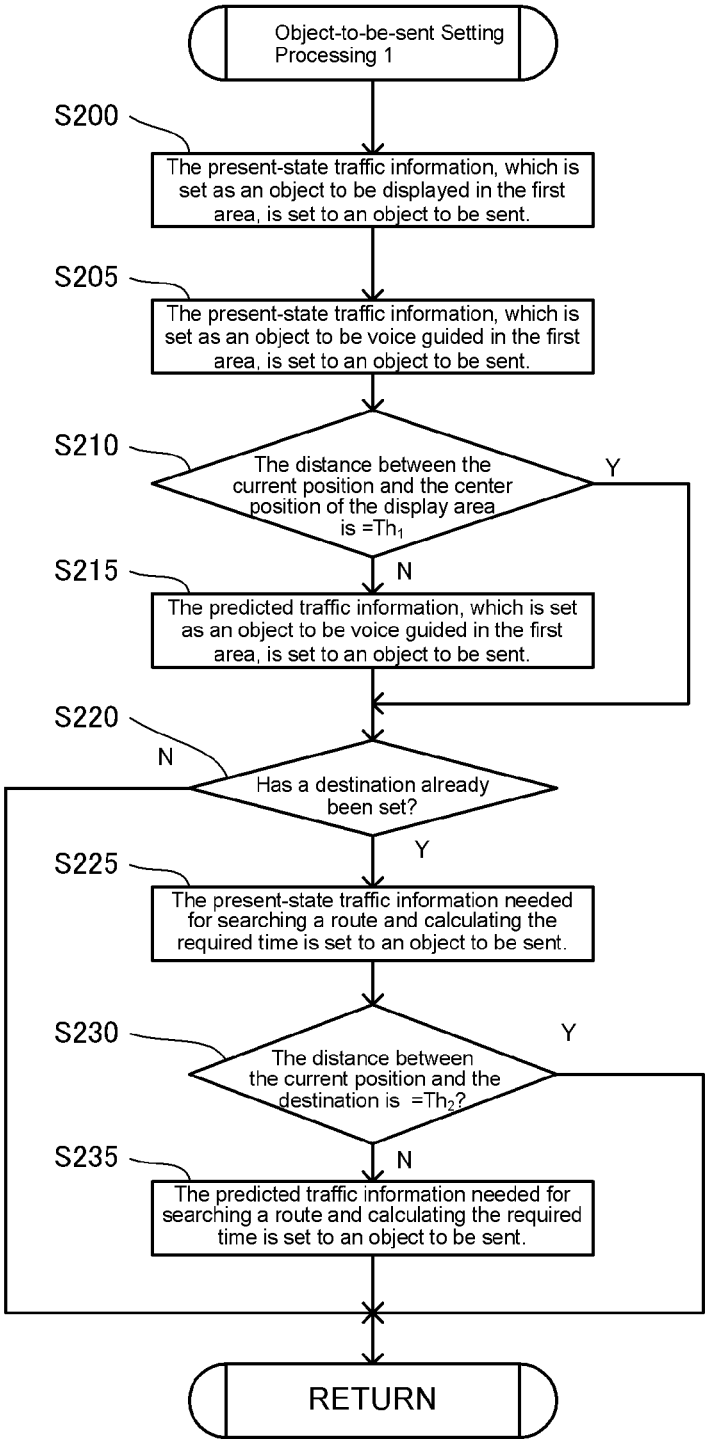
FIG. 3 is a flow chart illustrating an object-to-be-sent setting processing 1.

(1-3) Processing in the Case where Output Reason is an Instruction Given by User Operation Next, there will be described in detail the object-to-be-sent setting processing 1 in the case where the output reason of the request to send is the instruction given by the user operation. FIG. 3 is a flow chart illustrating the processing by the object-to-be-sent setting processing 1. In the processing shown in FIG. 3, the control unit 20 sets, as an object to be sent, the present-state traffic information to be displayed in a first area, which is a display area of a map when the instruction is given by the user operation (Step S200). Specifically, the control unit 20 refers to the information which is sent along with the request to send and indicates the display area of the map on the display unit of the user I/F unit 430. The control unit 20 identifies the display area of the map at the time the instruction was given by the user operation, as a first area. Moreover, this display area is defined as the first area, and all the present-state traffic information which may be an object to be displayed in the first area is set as an object to be sent.

Specifically, the control unit 200 of the vehicle C in the embodiment is configured to display, on the road section on the map, the degree-of-traffic-jam information and the regulatory information, which are the information to be displayed regarding each road section while displaying the map on the display unit of the user I/F unit 430. Thus, in the step S200, in the case where there is the information which is the present-state traffic information on the road section included in the first area and is defined as the information to be displayed, all the information is extracted to set as the object to be sent. Summing up, in the case where the request to send is made in response to the instruction given by the user operation of the vehicle C, the traffic information to be sent is set so as to identify the degree-of-traffic-jam information and the regulatory information on all the road sections which may be displayed for the first area displayed on the display unit of the user I/F unit 430 at that time.

Moreover, in the embodiment, the control unit 20 executes the processing for also setting the traffic information on the vocal guidance as an object to be sent. The vehicle C of the embodiment is configured such that the road section to be guided can be selected from the map which is displayed on the display unit when the instruction is given by the user operation, and the traffic jam information on the selected road section is guided by a speaker. In addition, the vehicle C is configured such that the weather information on the region displayed on the map is guided by the speaker in accordance with a user selection. Thus, the control unit 20 first sets the present-state traffic information on the first area to be voice guided as an object to be sent (Step S205). Specifically, traffic jam guidance information which indicates the current degree of traffic jam in the road section is extracted from the information to be voice guided regarding the road section included in the display area of the map on the display unit of the user I/F unit 430, to set the traffic jam guidance information as the present-state traffic information to be sent. Moreover, the weather information which indicates the current weather condition is extracted from the information to be voice guided regarding the region displayed in said display area, to set the weather information as the present-state traffic information to be sent.

Moreover, the control unit 20 refers to the information indicating the current position of the vehicle C and the information indicating the display area of the map on the display unit of the user I/F unit 430, which are sent along with the request to send, and determines whether the distance between the current position of the vehicle C and the center position of the display area is $Th_1$ or less (Step S210). In the case where the control unit 20 does not determine that the distance between the current position of the vehicle C and the center position of the display area is $Th_1$ or less, the control unit 20 sets the predicted traffic information on the first area to be voice guided as an object to be sent (Step S215). In Step S210, in the case where the control unit 20 determines that the distance between the current position of the vehicle C and the center position of the display area is $Th_1$ or less, the control unit 20 skips Step S215.

Specifically, in the embodiment, in the case where the distance between the current position of the vehicle C and the center position of the display area is more than $Th_1$, it is considered that while the vehicle C travels from the current position to the road section included in the display area, the condition of traffic jam and the weather condition will change from the current condition. In this case, the vehicle C is configured such that the predicted traffic jam information on the road section selected by the user operation is guided by the speaker and the predicted weather information on the region displayed on the map by the user selection is guided by the speaker. Therefore, in the case where the distance between the current position of the vehicle C and the center position of the display area is more than $Th_1$, the control unit 20 extracts the traffic jam guidance information which indicates the predicted degree of traffic jam in the road section from the information to be voice guided regarding the road section included in the display area of the map on the display unit of the user I/F unit 430, to set the traffic jam guidance information as the predicted traffic information to be sent. In addition, the control unit 20 extracts the weather information which indicates the predicted weather information from the information to be voice guided regarding the region displayed in the display area, to set the weather information as the present-state traffic information to be sent.

Moreover, in the embodiment, in the case where a destination is set for the vehicle C, the control unit 20 executes the processing for setting the information for route search, which is used for the route guidance to the destination, as the traffic information to be sent. Specifically, in the embodiment, the vehicle C is configured such that the user I/F unit 430 provides the user with the route guidance from the current position to the destination. In such configuration, the control unit 20 determines whether the destination has already been set (Step S220). Therefore, the control unit 20 determines whether the information indicating the destination, which is sent along with the request to send in the case where the destination of the vehicle C is set, is received.

In Step S220, in the case where the control unit 20 does not determine that the destination has already been set, Steps S225 to S235 are skipped. In Step S220, in the case where the control unit 20 determines that the destination has already been set, the control unit 20 sets, as an object to be sent, the present-state traffic information which is needed for searching a route from the current position to the destination and for calculating the amount of time required for reaching the destination from the current position (Step S225). Specifically, the control unit 200 of the vehicle C is configured to search a route based on the cost information for each road section associated with the degree of traffic jam and the regulation and to calculate the required time. In such configuration, the control unit 20 sets, as the present-state traffic information to be sent, the cost information which is the information for route search on the road sections from the current position to the destination in Step S225.

Moreover, the control unit 20 determines whether the distance between the current position of the vehicle C and the destination is $Th_2$ or less with reference to the information indicating the current position of the vehicle C and the information indicating the destination of the vehicle C (Step S230). In the case where the control unit 20 does not determine that the distance between the current position of the vehicle C and the destination is $Th_2$ or less, the control unit 20 sets, as an object to be sent, the predicted traffic information which is needed for searching a route from the current position to the destination and for calculating the amount of time required for reaching the destination from the current position (Step S235). In Step S230, in the case where the control unit 20 determines that the distance between the current position of the vehicle C and the destination is $Th_2$ or less, Step S235 is skipped.

Summing up, in the embodiment, in the case where the distance between the current position of the vehicle C and the destination is more than $Th_2$, it is considered that the traffic conditions will be changed from the current condition in the traveling process of the vehicle C from the current position to the destination. Here, in order to realize the route search and the calculation of the amount of time required in accordance with such change, in the case where the distance between the current position of the vehicle C and the destination is more than $Th_2$, the control unit 20 sets, as the predicted traffic information to be sent, the cost information which is the information for route search on the road sections between the current position and the destination.

Figure 4:
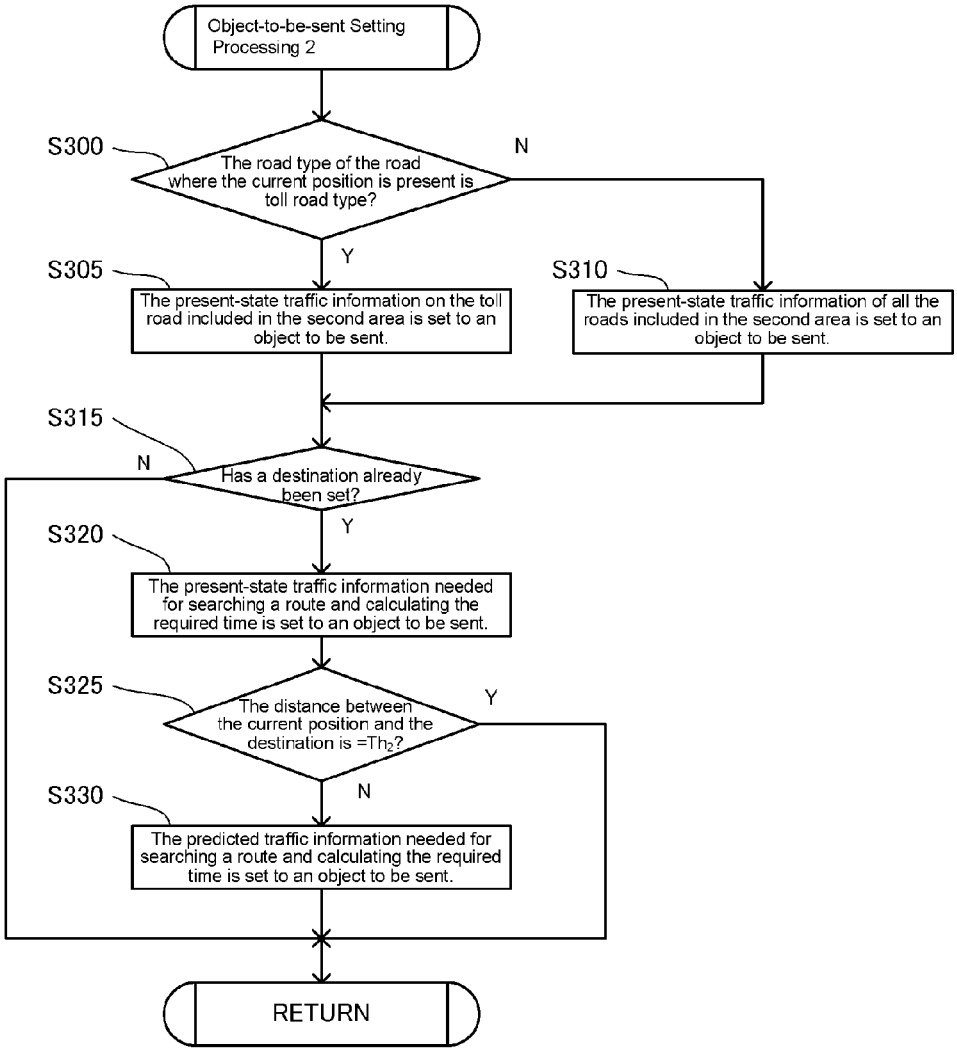
FIG. 4 is a flow chart illustrating an object-to-be-sent setting processing 2.

(1-4) Processing in the Case where Output Reason is an Automatically Given Instruction Next, there will be described in detail the object-to-be-sent setting processing 2 in the case where the output reason of the request to send is the automatically given instruction. FIG. 4 is a flow chart illustrating the processing by the object-to-be-sent setting processing 2. In the processing shown in FIG. 4, the control unit 20 determines whether a road type of the road where the current position of the vehicle C is present is toll road type (Step S300). Specifically, the control unit 20 identifies the road type of the road where the vehicle C traveled when the request to send was automatically made, with reference to the information which is sent along with the request to send and indicates the road type of the road where the current position of the vehicle C is present. Note that in the embodiment, the road types are toll road, open road, and residential road.

In Step S300, in the case where the control unit 20 determines that the road type of the road where the current position is present is toll road type, the control unit 20 defines the area having a predetermined range around the current position as a second area, and identifies a toll road included in the second area. Then, the control unit 20 sets, as the present-state traffic information to be sent, the degree-of-traffic-jam information and the regulatory information, which are the information to be displayed, regarding the toll road included in the second area (Step S305). In contrast, in Step S300, in the case where the control unit 20 does not determine that the road type of the road where the current position is present is toll road type, the control unit 20 defines the area having a predetermined range around the current position as the second area, and sets, as the present-state traffic information to be sent, the degree-of-traffic-jam information and the regulatory information, which are the information to be displayed, regarding all the roads included in the second area (Step S310).

In Steps S315 to S330, the control unit 20 executes the processing similar to the aforementioned Steps S220 to S235. Specifically, in the case where the destination has already been set, the control unit 20 sets, as the present-state traffic information to be sent, the cost information which is the information for route search that is needed for searching the route from the current position to the destination and for calculating the amount of time required for reaching the destination from the current position. In the case where the control unit 20 does not determine that the distance between the current position and the destination is the threshold $Th_2$ or less, the control unit 20 sets, as the predicted traffic information to be sent, the cost information which is the information for route search that is needed for searching route from the current position to the destination and for calculating the amount of time required for reaching the destination from the current position.

After executing the object-to-be-sent setting processing 1 and the object-to-be-sent setting processing 2, the control unit 20 returns to the processing shown in FIG. 2 and sends the traffic information to be sent in Step S120. As a result, in the vehicle C, the different traffic information 300*b* is received depending on the output reasons of the request to send, and is recorded on the recording medium 300. Therefore, in the vehicle C, it is possible to acquire and utilize the traffic information on the area in accordance with the output reasons of the request to send, which is output from the vehicle C.

In the forgoing processing, in the case where the output reason of the request to send is the instruction given by the user operation, the degree-of-traffic-jam information and the regulatory information, which constitute the present-state traffic information that may be displayed on the first area, are sent. Therefore, even in the case where the map on the display unit of the user I/F unit 430 is switched in response to the user operation, the degree-of-traffic-jam information and the regulatory information can be displayed in the display area of the switched map. Accordingly, it is possible to guide the degree-of-traffic-jam information and the regulatory information on the user's desired position.

Moreover, in the case where the output reason is the instruction given by the user operation, the present-state traffic information on all road types of roads included in the map is sent, with the map being displayed on the display unit when the request to send is output. With this configuration, in the case where an instruction is given by the user operation in sending the traffic information on the road, it is possible to use as an object to be sent the degree-of-traffic-jam information and the regulatory information constituting the present-state traffic information on all the road types without distinguishing the road type. As a result, in the vehicle C which received the sent present-state traffic information, it is possible to guide the degree-of-traffic-jam information and the regulatory information on all the road types of roads on the map displayed on the display unit.

In the case where the output reason of the request to send is the automatically given instruction, the degree-of-traffic-jam information and the regulatory information, which constitute the present-state traffic information on the second area set around the current position, are sent. Therefore, even if the current position of the vehicle is changed with the current position of the vehicle C being displayed on the display unit of the user I/F unit 430, the traffic information on the second area associated with said current position is automatically sent, and the map display can be switched depending on the current position of the vehicle C while displaying the degree-of-traffic-jam information and the regulatory information.

Moreover, in the case where the output reason of the request to send is the automatically given instruction, if the vehicle C is traveling on the toll road, the degree-of-traffic-jam information and the regulatory information, which constitute the present-state traffic information on the toll road type, are sent, but the present-state traffic information on other types of roads is not sent. Therefore, in the circumstances where the vehicle C needs not the traffic information on the road type other than the toll road type at the moment, and needs the traffic information on the toll road type, it is possible to automatically send the degree-of-traffic-jam information and the regulatory information, which constitute the needed present-state traffic information on the toll road type.

Furthermore, in the embodiment, in the case where the output reason of the request to send is the instruction given by the user operation, the information to be voice guided is sent, while in the case where the output reason of the request to send is the automatically given instruction, the information to be voice guided is not sent. Therefore, when the request to send is made with the map being switched on the display unit of the user I/F unit 430 in response to the user operation, the vocal guidance for the map which was displayed at the time of the request to send can be provided. Specifically, when the road section to be guided is selected from the map displayed on the display unit of the user I/F unit 430, the control unit 200 of the vehicle C voice guides the traffic jam information on the selected road section by the speaker. In addition, in the case where the output of the weather information is instructed, the control unit 200 voice guides the weather information on the region displayed on the map by the speaker. In the case where the distance between the region displayed on the display unit of the user I/F unit 430 and the current position of the vehicle C is more than $Th_2$, the control unit 200 can voice guide the predicted traffic jam information and the predicted weather information on each road section about the time when the vehicle C will reach said region, by the user selection.

(2) Other Embodiments

The foregoing embodiments are merely examples for implementing the present invention, and other various embodiments can be employed as long as the traffic information on the different areas is sent depending on the cases where the output reason is the instruction given by the user operation or the automatically given instruction. For example, in the aforementioned embodiments, the degree-of-traffic-jam information and the regulatory information are used as an object to be displayed on the display unit of the user I/F unit 430, and the weather information is used as an object to be voice guided by the speaker. However, other information may be used as an object to be displayed or voice guided.

Specifically, the degree-of-traffic-jam information and the regulatory information may be used as an object to be voice guided and the weather information may be used as an object to be displayed. Moreover, the present invention may be configured to send the predicted traffic information on the degree-of-traffic-jam information and the regulatory information. With this configuration, it is possible to display on the display unit of the user I/F unit 430 or voice guide by the speaker, the degree-of-traffic-jam information and the regulatory information which are predicted when the vehicle C reaches any road section. Furthermore, various techniques can be employed as the use of the traffic information in the vehicle C. The invention may be configured to display or voice guide the predetermined traffic information automatically or in response to the user operation.

The first area and the second area can be configured to be set by the various setting methods. For example, the first area may be consistent with the display area of the map on the display unit of the user I/F unit 430 as described above, and may be larger than the display area. The second area may be set to include at least the display area of the display unit.

Moreover, in the case where the output reason is the automatically given instruction, the invention may be configured to select the object-to-be-sent road type in accordance with the road type of the road where the current position is present, and to send the traffic information on one or more roads of the object-to-be-sent road type and not to send the traffic information on the road of the road type other than the object-to-be-sent road type. With this configuration, it is possible to limit the traffic information to be sent in accordance with the selection of the road type, and control the volume of the traffic information which is automatically sent. For example, in the case where the road where the vehicle C travels is an open road, the invention can employ the configuration in which the traffic information on the open roads and residential roads is sent, or the like.

In addition, the invention may employ the configuration in which even though the object to be sent of the traffic information is set by the road type or the like, the traffic information on a part of the type of road is excluded from the object to be sent. The invention may employ the configuration of not sending the traffic information on the road in the opposite direction to the traveling direction of the vehicle C in relation to the current position of the vehicle C. Moreover, the traffic information management device may be mounted on the vehicle C. Specifically, the invention may employ the configuration in which the vehicle C controls the traffic information management device 10 such that when the request to send is acquired, the output reason of the request to send is determined, the traffic information to be requested is identified in accordance with the output reason, and such identified traffic information is sent.

REFERENCE SIGNS LIST

10 Traffic Information Management Device
20 Control Unit
21 Traffic Information Management Program
21*a* Request-to-send Acquiring Unit
21*b* Output Reason Determining Unit
21*c* Traffic Information Transmission Control Unit
22 Communication Unit
30*a* Traffic Information
100 Navigation System
200 Control Unit
210 Navigation Program
220 Communication Unit
300*a* Map Information
300*b* Traffic Information
410 GPS Receiving Unit
420 Speed Sensor
430 User I/F Unit

The invention claimed is:

1. A traffic information management device comprising:
a memory storing a traffic information management program;
a communication circuit; and
a processor that, as a result of executing the stored traffic information management program:
acquires information indicating a display area of a map which is displayed on a display unit mounted on a vehicle;
acquires a current position of the vehicle;
acquires a request to send traffic information which is output in response to an instruction given by a user operation or an automatically given instruction;
determines an output reason of the request to send; and
controls the communication circuit to:
when the determined output reason is the instruction given by the user operation, send the traffic information on a first area, which is set to include at least the display area of the map at the time the instruction was given by the user operation; and
when the determined output reason is the automatically given instruction, send the traffic information on a second area, which is set around the current position.

2. The traffic information management device according to claim 1, wherein the processor, as a result of executing the stored information management program:
when the determined output reason is the instruction given by the user operation, controls the communication circuit to send the traffic information on all road types of roads included in the map which was displayed on the display unit at the time the request to send was output; and
when the determined output reason is the automatically given instruction, selects an object-to-be-sent road type in accordance with a road type of a road where the current position is present, and controls the communication circuit to send the traffic information on one or more roads of the object-to-be-sent road type.

3. The traffic information management device according to claim 2, wherein the processor, as a result of executing the stored information management program, when the determined output reason is the automatically given instruction:
selects a toll road type as the object-to-be-sent road type if the road type of the road where the current position is present is the toll road type; and
selects the all road types included in the map as the object-to-be-sent road type, if the road type of the road where the current position is present is other than the toll road type.

4. A traffic information management method comprising:
acquiring, with a processor, information indicating a display area of a map which is displayed on a display unit mounted on a vehicle;

acquiring, with the processor, a current position of the vehicle;

acquiring, with the processor, a request to send traffic information which is output in response to an instruction given by a user operation or an automatically given instruction;

determining, with the processor, an output reason of the request to send; and controlling, with the processor, a communication circuit to:

when the determined output reason is the instruction given by the user operation, send the traffic information on a first area, which is set to include at least the display area of the map at the time the instruction was given by the user operation; and when the determined output reason is the automatically given instruction, send the traffic information on a second area, which is set around the current position.

5. A non-transitory storage medium sorting a computer-executable traffic information management program, the program comprising:

instructions for acquiring information indicating a display area of a map which is displayed on a display unit mounted on a vehicle;

instructions for acquiring a current position of the vehicle;

instructions for acquiring a request to send traffic information which is output in response to an instruction given by a user operation or an automatically given instruction;

instructions for determining an output reason of the request to send; and instructions for controlling a communication circuit to:

when the determined output reason is the instruction given by the user operation, send the traffic information on a first area, which is set to include at least the display area of the map at the time the instruction was given by the user operation; and when the determined output reason is the automatically given instruction, send the traffic information on a second area, which is set around the current position.

* * * * *